US005707793A

United States Patent [19]

Oyamada

[11] Patent Number: 5,707,793

[45] **Date of Patent: *Jan. 13, 1998**

[54] SILVER HALIDE EMULSION AND SILVER HALIDE PHOTOGRAPHIC MATERIAL USING THE SAME

[75] Inventor: Takayoshi Oyamada, Kanagawa, Japan

[73] Assignee: Fuji Photo Film Co., Ltd., Kanagawa, Japan

[ * ] Notice: The term of this patent shall not extend beyond the expiration date of Pat. No. 5,665,630.

[21] Appl. No.: 634,791

[22] Filed: Apr. 19, 1996

[30] Foreign Application Priority Data

Apr. 19, 1995 [JP] Japan ..... 7-093589

[51] Int. Cl.[6] ..... G03C 1/035; G03C 1/015

[52] U.S. Cl. ..... 430/567; 430/569; 430/966

[58] Field of Search ..... 430/569, 567, 430/966

[56] References Cited

U.S. PATENT DOCUMENTS

| | | | |
|---|---|---|---|
| 5,264,337 | 11/1993 | Maskasky | 430/567 |
| 5,292,632 | 3/1994 | Maskasky | 430/567 |
| 5,310,635 | 5/1994 | Szajewski | 430/496 |
| 5,314,798 | 5/1994 | Brust et al. | 430/567 |
| 5,320,938 | 6/1994 | House et al. | 430/567 |
| 5,356,764 | 10/1994 | Szajewski et al. | 430/505 |
| 5,399,477 | 3/1995 | Maskasky | 430/567 |
| 5,411,852 | 5/1995 | Maskasky | 430/569 |
| 5,413,904 | 5/1995 | Chang et al. | 430/569 |

FOREIGN PATENT DOCUMENTS

| | | | |
|---|---|---|---|
| 0 534 395 | 9/1992 | European Pat. Off. | G03C 1/005 |
| 0 584 644 | 8/1993 | European Pat. Off. | G03C 1/005 |
| 0 616 255 | 3/1994 | European Pat. Off. | G03C 7/26 |
| 0 617 317 | 3/1994 | European Pat. Off. | G03C 1/005 |
| 0 617 318 | 3/1994 | European Pat. Off. | G03C 1/005 |
| 0 617 320 | 3/1994 | European Pat. Off. | G03C 1/005 |
| 0 617 321 | 3/1994 | European Pat. Off. | G03C 1/005 |
| 0 617 322 | 3/1994 | European Pat. Off. | G03C 1/005 |
| 0 617 325 | 3/1994 | European Pat. Off. | G03C 7/407 |
| 94/22051 | 9/1994 | WIPO | G03C 1/005 |
| 94/22054 | 9/1994 | WIPO | G03C 7/30 |

OTHER PUBLICATIONS

Journal of Crystal Growth 23 (1974) 207–213, A. Mignot, E.Francois et M. Catinat.

*Primary Examiner*—Mark F. Huff

*Attorney, Agent, or Firm*—Sughrue, Mion, Zinn, Macpeak & Seas, PLLC

[57] ABSTRACT

A silver halide emulsion is disclosed which comprises at least dispersing medium and silver halide grains, wherein the silver halide grains have an AgCl content of from 30 mol % to 100 mol %; at least 30% of the sum of the projected area of the silver halide grains accounts for tabular grains which satisfy the following conditions (i) to (v): (i) the tabular grains have {100} faces as major faces; (ii) the tabular grains have an aspect ratio (circle-equivalent diameter/thickness) of from 2.0 to 25; (iii) the tabular grains have an average thickness of from 0.02 μm to 0.3 μm; (iv) the tabular grains have an average major face edge length ratio of from 1 to 5; and (v) intermediate grains which have grown to the extent that the average projected area thereof is about 75% of that of the tabular grains have two dislocation lines extending from a nucleus the intermediate grains have, and an angle made by the two dislocation lines is from 5° to 85°.

The tabular grains for use in this invention is excellent in the anisotropic growing property, shows a very slow growing speed in the thickness direction and is excellent in the uniformity amount the grains and the silver halide emulsion is excellent in the sensitivity, the graininess, and spectral sensitization characteristics.

20 Claims, No Drawings

SILVER HALIDE EMULSION AND SILVER HALIDE PHOTOGRAPHIC MATERIAL USING THE SAME

FIELD OF THE INVENTION

The present invention relates to a silver halide (hereinafter sometimes referred to as "AgX") emulsion and a silver halide photographic material using it, and in particular, relates to an AgX emulsion containing tabular AgX grains wherein the major face is a {100} face and a silver halide photographic material using it.

BACKGROUND OF THE INVENTION

When a photographic emulsion containing tabular AgX grains is used for a photographic light-sensitive material (hereinafter sometimes referred to as "photographic material"), the color sensitization property, the sharpness, the light-scattering property, the covering power, the development proceeding property, the graininess, etc., are improved as compared with the case of using a photographic emulsion containing non-tabular AgX grains. Thus, tabular AgX grains having twin planes which are parallel with each other, wherein the major face is the {111} face, has been frequently used.

However, when a large amount of a sensitizing dye is adsorbed on AgX grains, the color sensitization characteristics are usually better in the case of AgX grains having a {100} face. Accordingly, the development of tabular AgX grains of which the major face is the {100} plane has been desired.

The {100} tabular grains wherein the form of the major face is a right-angled parallel quadrilateral are described in JP-A-51-88017 (the term "JP-A" as used herein means an "unexamined published Japanese patent application"), JP-B-64-8323 (the term "JP-B" as used herein means an "examined published Japanese patent application"), European Patent 0,534,395A1, U.S. Pat. Nos. 5,292,632, 5,264,337, and 5,320,938, and JP-A-6-59360. However, in these patent publications, there are no descriptions that it is particularly preferable in the anisotropic growing property, the sensitivity, and fog to grow the tabular AgX grains while leaving the acute-angled dislocation lines of this invention. Also, when the examples described in these patent publications were tried, when intermediate AgX grains grown to the extent that the average projected area is 75% or more of the average projected area of the finished grains, more than 30% of the average projected area the dislocation lines of this invention could not be confirmed in the average projected area of the grains more than 30% of the total projected area.

Also, it is described in *Journal of Crystal Growth*, 23, 207–213(1974) that AgX grains grow by the dislocations but the dislocation lines described in the report cross at a right angle each other and are different from the dislocation lines of the AgX grains of this invention. When the anisotropic growth of AgX grains occur with the two dislocation lines extending the {100} directions, in the case that the dislocation lines cross at a right angle each other, the form of the AgX grains becomes a semicircular form wherein the one corner of the major face becomes round, while in the case that the dislocation lines do not cross at a right angle each other, the AgX grains becomes acicular grains, and thus each case becomes inferior in the formation of the {100} tabular AgX grains.

SUMMARY OF THE INVENTION

An object of the present invention is to provide an AgX emulsion showing a good anisotropic growing property, showing a very low growing speed in the thickness direction, having more excellent uniformity among the grains, and having more excellent sensitivity, graininess, and spectral sensitization characteristics and also to provide a photographic light-sensitive material using the AgX emulsion.

It has now been discovered that the object described above can be attained by the present invention described hereinbelow.

That is, according to the 1st aspect of the present invention, there is provided a silver halide emulsion containing at least a dispersing medium and silver halide grains, wherein the AgCl content of said silver halide emulsion is from 30 mol % to 100 mol %; and at least 30% of the sum of the projected area of said silver halide grains are tabular grains which satisfy the following conditions (i) to (v): (i) the major face is the {100} face; (ii) the aspect ratio (circle-equivalent diameter/thickness) is from 2.0 to 25; (iii) the average thickness of said tabular grains is from 0.02 to 0.3 μm; (iv) the average major face edge length ratio of the tabular grains is from 1 to 5; and (v) intermediate grains which have grown to the extent that the average projected area thereof is about 75% of that of said (finished) tabular grains have two dislocation lines extending form a nucleus that the intermediate grains have, when observed from the perpendicular to the major face thereof; and the angle made by said two dislocation lines is from 5° to 85°.

According to the 2nd aspect of this invention, there is provided the silver halide emulsion of the 1st aspect, wherein said dislocation lines exist in intermediate grains which have grown to the extent that the average projected area thereof is about 85% of that of said (finished) tabular grains.

According to the 3rd aspect of this invention, there is provided the silver halide emulsion of the 1st aspect, wherein said dislocation lines exist in intermediate grains which have grown to the extent that the average projected area thereof is about 99% of that of said (finished) tabular grains.

According to the 4th aspect of this invention, there is provided the silver halide emulsion of the aspect 1, wherein said dislocation lines exist in said (finished) tabular grains coated in a silver halide photographic material.

According to the 5th aspect of this invention, there is provided the silver halide emulsion of the aspects 1 to 4, wherein said tabular grains are observed from the direction perpendicular to the major face thereof, the angle made by said two dislocation lines is from 30° to 75°.

According to the 6th aspect of this invention, there is provided the silver halide emulsion of the aspects 1 to 4, wherein said tabular grains are observed from the direction perpendicular to the major face thereof, the angle made by said two dislocation lines is from 45° to 75°.

According to the 7th aspect of this invention, there is provided the silver halide emulsion of the aspects 1 to 6, wherein said tabular grains exist at least 45% of the sum of the projected area of said silver halide grains.

According to the 8th aspect of this invention, there is provided the silver halide emulsion of the aspects 1 to 7, wherein said tabular grains exist at least 60% of the sum of the projected area of said silver halide grains.

According to the 9th aspect of this invention, there is provided the silver halide emulsion of the aspects 1 to 8, wherein the AgCl content of said tabular silver halide grains is from 50 mol % to 100 mol %.

According to the 10th aspect of this invention, there is provided the silver halide emulsion of the aspects 1 to 9, wherein the AgCl content of said tabular silver halide grains is from 80 mol % to 100 mol %.

According to the 11th aspect of this invention, there is provided the silver halide emulsion of the aspects 1 to 10, wherein when said tabular grains are observed in the direction perpendicular to the major face thereof, the nucleus at the nucleation exists in the range of a regular square of from 0.001% to 10% of the projection area of each of said tabular grains, the regular square including one corner of each of the tabular grains.

According to the 12th aspect of this invention, there is provided the silver halide emulsion of the aspects 1 to 11, wherein said emulsion is subjected to a gold sensitization and/or a calcogen sensitization.

According to the 13th aspect of this invention, there is provided a silver halide photographic material having on at least one side of a support at least one silver halide emulsion described in the aspects 1 to 12.

According to the 14th aspect of this invention, there is provided a silver halide photographic material having on both sides of a support at least one silver halide emulsion described in the aspects 1 to 12.

According to the 15th aspect of this invention, there is provided the silver halide photographic material of the aspect 14, wherein said silver halide photographic material is used as a combination of fluorescent intensifying screen emitting light by an X ray exposure having a peak at a wavelength of from 200 nm to 400 nm.

DETAILED DESCRIPTION OF THE INVENTION

Then, the present invention is described in detail.

In the present specification, the projected area of the tabular grains means a projected area of grains when the AgX emulsion grains are disposed so that the grains are not overlapped each other and major faces of the tabular grains are parallel to the substrate. The circle-equivalent diameter of the tabular grain means the diameter of a circle having an area equal to the projected area of the tabular grain. Also, the thickness thereof means the distance between the major faces of the tabular grain. The aspect ratio is the value obtained by dividing the circle-equivalent diameter (diameter) of the tabular grain by the thickness of the tabular grain.

The average thickness of tabular grains having an aspect ratio of from 2.0 to 25 is the average value of the thicknesses of the tabular grains and is preferably from 0.02 μm to 0.3 μm, more preferably from 0.02 μm to 0.25 μm, and furthermore preferably from 0.05 μm to 0.25 μm. The circle-equivalent diameters of the tabular grains having an aspect ratio of from 2.0 to 25 are preferably from 0.1 μm to 8 μm, more preferably from 0.2 μm to 5 μm, and furthermore preferably from 0.3 μm to 2 μm. The circle-equivalent distribution of the tabular grains having an aspect ratio of from 2.0 to 25 is preferably a monodisperse and the variation coefficient (standard deviation/average diameter) of said distribution is preferably from 0 to 0.4, more preferably from 0 to 0.3, and furthermore preferably from 0 to 0.2. Also, the form of the major face of the tabular grain having an aspect ratio of from 2.0 to 25 is preferably a right-angled parallelogram and the average major face edge length ratio [(the length of the long edge/the length of the short edge) of each grain]is preferably from 1 to 5, more preferably from 1 to 3, and furthermore preferably from 1 to 2.

The AgX emulsion of the present invention is an AgX emulsion containing at least a dispersion medium and AgX grains and at least 30%, preferably at least 45%, and furthermore preferably at least 60% of the sum of the projected area of the AgX grains are tabular grains which satisfy the above conditions (i) to (v) (hereinafter sometimes referred to as "tabular grain"). The tabular grains have an aspect ratio is from 2 to 25, preferably from 2 to 20, and more preferably from 2 to 15.

For forming the tabular AgX grains, it is necessary that at the nucleation, crystal defects such as screw dislocations are incorporated and the growth of the grains is accelerated in a specific direction. The crystal defects have not yet been clearly confirmed to be the screw dislocations but from the anisotropic growing condition of the grains, it is considered that there is a possibility of being the screw dislocations. Also, since the dislocations become a driving force of the growth of the tabular grains, it is preferred that the dislocation lines are not vanished during the formation of the grains.

The term that the projected area of (intermediate) tabular grains during the growth of the tabular grains is x% of the projected area of the finished grains is shown by (the average projected area (fine grains are not counted) of the (intermediate) tabular grains during growth (samples during the growth)/the projected area of the finished grains)×100.

In the AgX composition of the AgX grains of the present invention, the content of AgCl is from 30 mol % to 100 mol %, preferably from 50 mol % to 100 mol %, and furthermore preferably from 80 mol % to 100 mol %.

The corner of the tabular AgX grains is the portion that the side faces of the {100} tabular grain cross. Thus, the tabular grain usually has 4 corners.

The portion of the nucleus of the tabular AgX grain is the portion of the grain invested with anisotropic growing property by halide gap by the inclusion of different halides and/or impurities, which grain intrinsically does not have anisotropic growing property. The anisotropic growing property is often imparted by introducing the dislocations, etc., to the grains.

It is a feature of this invention that the nucleus of the tabular grain of this invention exists in the range of a regular square including one corner of the grain and of preferably from 0.001% to 10%, and more preferably from 0.001% to 7% of the projected area of the tabular grain. About the nucleus, the strain of the lattice is frequently observed by a direct method low-temperature transmission type electron microphotographic image (hereinafter referred to as "direct TEM image") to confirm the existing place thereof. Also, in regard to the nucleus, if the existing position of the nucleus can be indirectly confirmed by a method of adding the history of the growth by a method of adding a different kind of a halogen such as $I^-$ and/or $Br^-$, etc., in an amount of preferably from 0.01 mol % to 5 mol %, more preferably from 0.05 mol % to 3 mol %, and furthermore preferably from 0.1 mol % to 1 mol % and by the direct TEM image or in the case of $I^-$, by observing the low-temperature emission [e.g., the description of *Journal of Imaging Science*, Vol. 31, 15–26 (1987)]can be referred to], the lattice strain of the nucleus portion may not be observed by the direct TEM image. Also, the composition of the nucleus of the grain of the present invention frequently differs from the composition of other portions but the composition of the former is not always different from that of the latter. Furthermore, in this case, it is necessary that the existing position of the nucleus can be confirmed by adding a history of growth into the nucleus.

Another feature of the tabular AgX grains in this invention is that when the tabular grain is observed by the direct TEM image in the direction perpendicular to the major face thereof, the grain has two dislocation lines extending from the nucleus. The dislocation lines are preferably maintained until the projection area of the (intermediate) tabular grains during growing becomes 75% of the projected area of the finished grains, more preferably maintained until the former projected area becomes 85% of the projection area of the latter, and particularly preferably maintained until the former projected area becomes 99% of the projected area of the latter. Also, the dislocation lines frequently directly extend from the nucleus at nucleation but even if a part of the extending dislocation lines is vanished, when the extension of the dislocation lines reaches the nucleus at the nucleation, the tabular grains are the tabular grains of this invention.

Also, in other feature of the present invention, when the tabular grain is observed in the direction perpendicular to the major face of the grain, the angle made by the dislocation lines is from 5° to 85°, preferably from 30° to 75°, and more preferably from 45° to 75° C. It is also a feature of this invention that when the side face of the tabular grain is the {100}face, the dislocation lines are frequently introduced into the (31n) direction.

For forming the tabular AgX grains having the foregoing structure, it is a feature of this invention that the dislocation lines introduced at the nucleation are not vanished.

In the {100} tabular AgX grains, it is observed that the dislocation lines introduced at the nucleation are vanished during the formation of the grains, such as, for example, during physical ripening or during the growth of the grains and the tabular grains become thick. Thus, ripening is carried out, for example, in the existence of fine grains so that dislocation lines shall not be vanished with the dissolution of each corner of the tabular grains and also the growth of the tabular grains must be carried out in the state that the dislocation lines remain. Furthermore, for letting the dislocation lines stably exist, it is necessary that the dislocation lines introduced are subjected to pinning. For the purpose, there are a method of carrying out the growth of the tabular grains not with a single halogen composition but with mixed halogens containing different kind of halogen(s) in an amount of preferably from 0.1 mol % to 25 mol %, more preferably from 0.5 mol % to 10 mol %, and particularly preferably from 0.7 mol % to 7 mol %; a method of growing the tabular grains with an aqueous halogen solution of a single halogen composition containing an impurity such as potassium ferricyanide, etc., in an amount of preferably from 0.1 mol % to 20 mol %, and more preferably from 0.2 mol % to 10 mol %; a method of growing the tabular grains by lowering the growing temperature for making difficult to remove pinning of the dislocation lines to a temperature of from 30° C. to 75° C., and more preferably from 35° C. to 65° C., etc., and these methods may be used singly or as a combination of them. Furthermore, for growing the tabular grains while maintaining the anisotropic growing property, a low-supersaturation addition of an $Ag^+$ salt solution and X– salt solution may be carried out.

Then, an example of the direct TEM method is shown below.

1. Preparation of Sample

After adding an AgX emulsion during the formation of AgX grains and/or after the formation of AgX grains to a methanol solution of a grain deformation inhibitor-1 or phenylmercaptotetrazole ($1\times10^{-3}$ to $1\times10^{-2}$ mol/mol-Ag) for inhibiting the occurrence of the deformation of the AgX grains, the AgX formed were collected by a centrifugal separation and dropped on a sample support stand (mesh) for an electron microscopic observation previously stuck with a carbon supporting film and dried to prepare a sample.

2. Observation of AgX Grain

The sample thus prepared was observed by an electron microscope JEM-2000 FXII manufactured by JEOL LTD., at an acceleration voltage of 200 kV and a magnification of from 5,000 to 50,000 magnifications, using a sample cooling holder, 626-0300 Cryostation manufactured by Gantan Co., and at an observation temperature of −120° C. In addition, in regard to the grain the dislocation lines of which could not observed, the observation was carried out by inclining the sample to confirm the presence or absence of the dislocations.

Grain deformation inhibitor-1

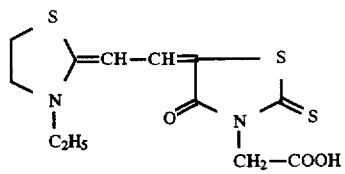

It is preferred to carry out ripening and/or the growth of the tabular grains under the condition of pCl of not higher than 2.8 and not lower than 1.6, and preferably pCl of not higher than 2.5 and not lower than 1.6. In the case of the tabular AgX grains of other halogen composition structure, it is preferred to form the grains under the foregoing $Cl^-$ concentration. This is because it is preferred to carry out the formation of the tabular AgX grains under the condition of forming cubic grains and also the foregoing $Cl^-$ concentration condition corresponds to the condition for forming cubic grains. The excessive $Cl^-$ can be regarded as a kind of a crystal habit controlling agent.

About the AgX grains of this invention, the anisotropic growth of the grain growth can be carried out with fine AgX grains.

Since it is preferred the super saturation degree of the system is minimum, as the adding fine grains, it is preferred to use the fine grains having the largest grain size, which can be vanished. Since the size of the fine grains which can be vanished differs according to the side of said {100} tabular grains, it is preferred to gradually increase the size of the adding fine grains. Using the fine AgX grains, the tabular AgX grains are grown by Ostwald ripening. The fine AgX grain emulsion can be added continuously or intermittently. The fine grain emulsion can be continuously prepared in a mixing vessel disposed near the reaction vessel by supplying therein an aqueous $AgNO_3$ solution and an aqueous $X^-$ salt solution and immediately added continuously to the reaction vessel, or after previously prepared the fine grain emulsion in a batch system in a separate vessel, the emulsion can be added to the reaction vessel continuously or intermittently. The fine grain emulsion can be added in a liquid state or as a dried powder thereof. In this case, it is preferred that the fine AgX grains do not substantially contain multiplet twin-crystalline grains. The term "multiplet twin-crystalline grains" means the AgX grains each having two or more twin planes. Also, the term "do not substantially contain" means that the content of the multiplet twin-crystalline grains is from 0% to 5%, preferably from 0% to 1%, and more preferably from 0% to 0.1%.

Furthermore, it is preferred that the fine AgX grains being added do not substantially contain single twin-crystalline grains. Moreover, it is preferred that the fine AgX grains do not substantially contain screw dislocations. In these cases, the term "do not substantially contain" is as defined above.

The halogen composition of the fine AgX grains being added is mixed crystals of two or more kinds of AgCl, AgBr and AgBrI (wherein the content of $I^-$ is preferably from 0 mol % to 20%, and more preferably from 0 mol % to 10 mol %), containing a different kind of halogen in an amount of preferably from 0.1 mol % to 25 mol %, more preferably from 0.5 mol %, and particularly from 0.7 mol % to 7 mol %; or AgCI, AgBr or AgBrI (wherein the content of $I^-$ is preferably from 0 mol % to 20 mol %, and more preferably from 0 mol % to 10 mol %), containing an impurity such as potassium ferricyanide, etc., in an amount of preferably from 0.1 mol % to 20 mol %, and more preferably from 0.2 mol % to 20 mol %, and mixed crystals thereof.

Then, the preparation method of the fine AgX grains is described in detail.

First, the method is explained successively from the nucleation step.

(1) Nucleation

In an aqueous solution containing at least a dispersion medium and water, $Ag^+$ is reacted with a halogen ($X_1^-$) to form $AgX_1$ nuclei as the host silver halide nuclei. Then, an aqueous solution of a different kind of halogen ($X_2^-$) is added or an impurity (potassium ferrocyanide, etc.) is added thereto to substantially form dislocations, which become the cause of forming tabular AgX grains. For forming the dislocations of this invention, it is necessary to form a {100} face forming atmosphere as the reaction condition. Also, since the formation of the dislocations of this invention is usually slow, it is necessary that the mixture is maintained as it is for a definite time (preferably from 3 minutes to 100 minutes, and more preferably from 7 minutes to 60 minutes) after the addition of the solution of different kind $X_2$ or the impurity without adding any more.

Also, as the crystal habit controlling agent which is necessary in the nucleation, there are the compounds described in European Patent 0.534,395A1, gelatin having a high methionine content (a content of preferably from 10 μmol/g to 300 μmol/g, and more preferably from 30 μmol/g to 200 μmol/g), and water-soluble dispersion media known for AgX emulsions (about these dispersion media, the descriptions of *Research Disclosure*, Vol. 307, Item 307105, November, 1989 can be referred to, and, in particular, the dispersion media described in JP-B-52-16365, JP-A-59-8604, and *Journal of Imagine in Science*, Vol. 31, 148–156 (1987) are more preferred).

The nucleation temperature is preferably from 20° C. to 80° C., and more preferably from 25° C. to 50° C. When the size of the nuclei is small, ripening easily proceed and it is convenience for forming thin tabular grains. For the purpose, it is preferred to carry out the nucleation at a low temperature. For forming the dislocations of this invention, an energy is required. For satisfying both the conditions, the formation of the AgX nuclei is carried out at a low temperature and at the formation of the dislocations, the temperature may be increased by a temperature of preferably from 2° C. to 30° C., and more preferably from 5° C. to 30° C.

It is preferred that after introducing the dislocations of this invention and before ripening, an aqueous $Ag^+$ solution and an aqueous $Cl^-$ solution are added. The addition of the halogen can stop the introduction of the dislocations of this invention.

The dislocations are introduced into AgX grains by a halogen gap or an impurity, etc., but if the number of the dislocation lines introduced into the grain is 3 or more, the growth of the grains finally obtained is accelerated to the directions of the x, y, and z axes, whereby thick grains having a low aspect ratio are formed. Accordingly, the formation amount of the dislocations may be controlled such that the frequency of the formation of thick grains is reduced and the frequency of forming tabular grains is increased. For controlling the formation amount of the dislocations, the kind of the kind and the addition amount of halogen ($X_2$) and the kind and the addition amount of the impurity for forming the dislocations can be properly selected by trial and error. Also, about the halogen being used for ripening and for stopping the introduction of the dislocations of this invention, the kind and the addition amount of the halogen can be properly selected by trial and error.

(2) Ripening

It is difficult to separately prepare the tabular grain nuclei only at nucleation. Accordingly, other AgX grains than the tabular AgX grains are extinguished by Ostwald ripening in the subsequent ripening step. It is preferred that the temperature for ripening is higher than the nucleation temperature by a temperature of from 10° C. to 60° C. and usually a temperature of from 50° C. to 80° C. is used for ripening. By ripening, non-tabular AgX grains are vanished and deposited on the tabular AgX grains. In this case, it is preferred that fine AgX grains having the composition and the size, which are more easily dissolved than the tabular AgX grains exist in the initial step of said ripening such that the tabular AgX grains are reluctant to vanish in the initial step of said ripening. Also, it is desirable that the introduction of new dislocations does not occur during ripening and for the purpose, it is preferred that after the addition of the different kind of halogen or the impurity, the system is allowed to stand for a sufficient time to form an equilibrium state and the influence of the different kind of halogen or the impurity is reduced near zero or to zero if possible.

It is preferred that ripening is not carried out until the fine grains are all vanished. This is because, if the fine grains are all vanished, the corners of the tabular grains are dissolved, the dislocation lines are vanished, grains of reducing the anisotropic growing property began to exist. Thus, it is necessary to initiate growing the tabular grains during existing the fine grains and during existing the dislocation lines.

(3) Growth

After ripening described above, the tabular AgX grains can be, if necessary, grown to a desired size. In this case, there are (1) an ion-addition method of growing the tabular grains by adding an aqueous $Ag^+$salt solution and an aqueous $X^-$ salt solution each in a low super saturation, (2) a fine grain-addition method of growing the tabular grains by previously forming fine AgX grains and adding said fine grains, and (3) a method of using both the methods (1) and (2).

In each case, it is necessary to grow the tabular grains in the existence of an impurity such as a ferrocyanide, etc., or growing the tabular grains with a mixed halogen. Also, in each case, it is preferred that fine AgX grains exist in the system.

There is no particular restriction on the condition for the chemical sensitization in this invention but as the condition of the chemical sensitization, pAg is usually from 6 to 11, and preferably from 7 to 10 and the temperature is usually from 40° C. to 95° C., and preferably from 45° C. to 85° C.

In the present invention, for the chemical sensitization, it is preferred to use a noble metal sensitized such as gold, platinum, palladium, iridium, etc., together. In particular, it is preferred to use a gold sensitized together and specific examples of the gold sensitized are chloroauric acid, potassium chloroaurate, potassium auric thiocyanate, gold sulfide, and gold selenide, and such a gold sensitized can be used in an amount of about from $10^{-7}$ mol/mol-Ag to $10^{-2}$ mol/mol-Ag.

In the present invention, it is also preferred to use a sulfur sensitizer together. Specific examples of the sulfur sensitizer are known unstable sulfur compounds such as thiosulfates (e.g., hypo), thioureas (e.g., diphenylurea, triethylurea, and allylthiourea), rhodanines, etc., and the sulfur sensitizer can be used in an amount of from about $10^{-7}$ mol/mol-Ag to $10^{-2}$ mol/mol-Ag.

Furthermore, in the present invention, it is preferred to use a selenium sensitized together.

For example, the unstable selenium sensitizers described in JP-B-44-15748 are preferably used in this invention.

Specifically, as such selenium sensitizers, there are colloidal selenium, selenoureas (e.g., N,N-dimethylselenourea, selenourea, and tetramethylselenourea), selenoamides (e.g., selenoamide and N,N-dimethylselenobenzamide), selenoketones (e.g., selenoacetone and selenobenzophenone), selenides (e.g., triphenylphosphine selenide and diethyl selenide), selenophosphates (e.g., tri-p-tolylselenophosphate), selenocarboxylic acids and the esters thereof, isoselenocyanates, etc., and the selenium sensitizer can be used in an amount of from about $10^{-8}$ mol/mol-Ag to $10^{-3}$ mol/mol-Ag.

Also, in the present invention, it is preferred to apply a tellurium sensitization in the existence of a silver halide solvent.

As the specific examples of the silver halide solvent, there are thiocyanates (e.g., potassium thiocyanate), thioether compounds (e.g., the compounds described in U.S. Pat. Nos. 3,021,215 and 3,271,157, JP-B-58-30571, JP-A-60-136736, etc., in particular, for example, 3,6-dithia-1,8octanediol), tetra-substituted thiourea compounds (e.g., the compounds described in JP-B-59-11892, U.S. Pat. No. 4,221,863, etc., in particular, for example, tetramethylthiourea), the thion compounds described in JP-B-60-11341, the mercapto compounds described in JP-B-63-29727, the mesoionic compounds described in JP-B-60-163042, the selenoether compounds described in U.S. Pat. No. 4,782,013, the telluroether compounds described in JP-A-2-118566, and sulfites. In these compounds, the thiocyanates, the thioether compounds, the tetra-substituted thiourea compounds, and thion compounds can be particularly preferably used. The amount of the compound being used is in an amount of from about $10^{-5}$ mol/mol-Ag to $10^{-2}$ mol/mol-Ag.

In particular, the preferred using examples and the preferred compound examples thereof are described in detain, for example, in JP-A-3-116132, JP-A-5-113635, JP-A-5-165136, JP-A-5-165137, JP-A-5-134345, etc.

As the selenium sensitizers which are particularly preferably used, there are Selenium compound-I to Selenium Compound-X shown below.

Also, as the tellurium sensitizers particularly preferably used in this invention, there are Tellurium Compound-I to Tellurium Compound-X shown below.

Selenium Compound - 1

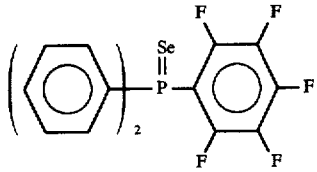

Selenium Compound - II

KSeCN

Selenium Compound - III

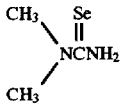

Selenium Compound - IV

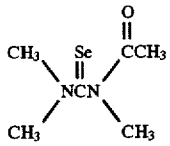

Selenium Compound - V

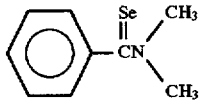

Selenium Compound - VI

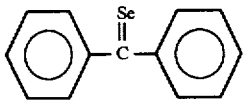

Selenium Compound - VII

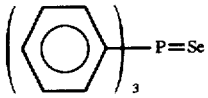

Selenium Compound - VIII

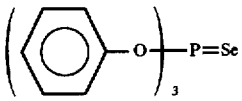

Selenium Compound - IX

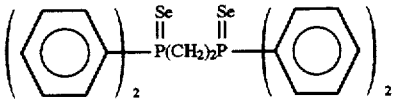

Selenium Compound - X

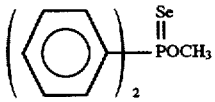

-continued

Tellurium Compound - I

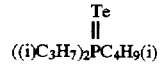

Tellurium Compound - II

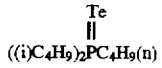

Tellurium Compound - III

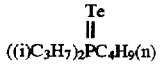

Tellurium Compound - IV

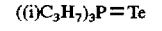

Tellurium Compound - V

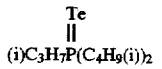

Tellurium Compound - VI

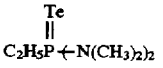

Tellurium Compound - VII

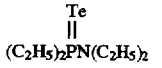

Tellurium Compound - VIII

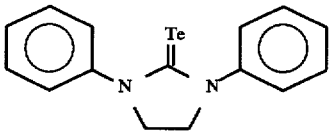

Tellurium Compound - IX

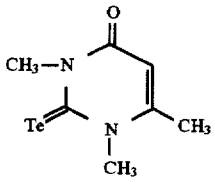

Tellurium Compound - X

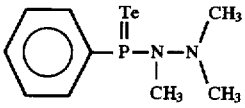

Also, it is preferred that the AgX emulsion of this invention is subjected to a reduction sensitization. As the method for the reduction sensitization, ascorbic acid and the derivatives thereof, thiourea dioxide, stannous chloride, aminoiminomethanesulfinic acid, hydrazine derivatives, borane compounds, silane compounds, polyamine compounds, etc., can be used as the reducing agent as described in JP-A-2-191938, JP-A-2-136852, JP-B-57-33572, etc. Also, by ripening the AgX emulsion while keeping the pH of the emulsion below 7 or keeping the pAg thereof below 8.3, the emulsion can be reduction-sensitized. Furthermore, by introducing a single addition portion of a silver ion into the emulsion during the formation of the AgX grains, the emulsion can be reduction-sensitized.

However, for the points of reducing the influences of the grain formation and the crystal growth and carrying out a controlled reduction sensitization, it is preferred to carrying out the reduction sensitization using ascorbic acid or the derivative thereof, or thiourea dioxide.

The amount of the reduction sensitizer differs according to the kind of the reducing agent but is preferably from $10^{-7}$ to $10^{-2}$ mol/Ag-mol.

The reduction sensitization may be carried out at any step during growing of the AgX grains or even after the formation of AgX grains, the reduction sensitization may be carried out at any step before the chemical sensitization of the emulsion.

Since the greater parts of the tabular grains are the {100} faces, the absorption of the gelatin absorption group (e.g., methionine group) to $Ag^+$ of the grain surface is strong. Thus, it sometimes happens that the absorption of spectral sensitizing dyes, antifogging agents, and other photographic additives is hindered. In this case, a dispersion medium gelatin having an optimum methionine content can be selected. Practically, an embodiment that the average methionine content of gelatin in the AgX emulsion layer of the photographic light-sensitive material is preferably from 0 to 50 μmol/g, and more preferably from 3 to 30 μmol can be employed.

Using the AgX grains obtained as the host AgX grains, epitaxial grains may be formed at the edges and/or the corners of the AgX grains. Also, using the AgX grains as cores, the AgX grains having the dislocations in the insides thereof may be formed. Furthermore, using these AgX grains as substrates, AgX layer of a different halogen composition from that of the substrates is laminated to form various grains of known any grain structures can be formed. About these AgX grains, the descriptions of the publications shown below can be referred to. Also, usually, chemical sensitizing nuclei are imparted to the emulsion grains obtained.

In this case, it is preferred that the forming places and the number/$cm^2$ of the chemical sensitizing nuclei are controlled. In regard to them, the descriptions of JP-A-2-838, JP-A-2-146033, JP-A-1-201651, JP-A-3-121445, JP-A-64-74540, JP-A-4-308840, JP-A-4-343348 and Japanese Patent Application Hei. 3-140712 can be referred to.

The AgX emulsion of this invention can be used by blending with other one or more kinds of AgX emulsions. As to the blending mole ratio, the optimum ratio may be suitable selected in the range of 0.01 to 1.0.

The AgX emulsion of the present invention can be used for any photographic light-sensitive materials.

The photographic light-sensitive material of the present invention can be preferably used for X-ray photographing using, for example, the following fluorescent substances as the fluorescent intensifying screens.

Blue Light-Emitting Fluorescent Substance:

$Y_2O_2S$:Tb, LaOBr:Tb and BaFCl:Eu

Green Light-Emitting Fluorescent Substance:

$Gd_2O_2$:Tb and $LaO_2S$:Tb

As the method of forming images using the photographic light-sensitive material of the present invention, there is a method of forming images by a combination of the photographic light-sensitive material and a fluorescent substance having the main peak at a wavelength of not longer than 400 nm. More preferably, a method of forming images by combining the photographic light-sensitive material with a fluorescent substance having the main peak at a wavelength of not longer than 380 nm is better.

As a fluorescent intensifying screen having the main light-emitting peak at a wavelength region of not longer than 400 nm, the screens described in JP-A-6-11804 and WO 93/01521 are used but the screens for use in this invention are not limited to them.

The light-emitting wavelength of the fluorescent substance in this invention is preferably not longer than 400 nm, and more preferably not longer than 370 nm.

As the typical fluorescent substance being used in this invention, there are M'-phase $YTaO_4$ singly or the compound composed of M'-phase $YTaO_4$ added with Gd, Bi, Pb, Ce, Se, Al, Rb, Ca, Cr, Cd, Nb, etc.; the compound composed of LaOBr added with Gd, Tm, Gd and Tm, Gd and Ce, or Tb; the oxide of HfZr or the compound composed of the oxide added with Ge, Ti, an alkali metal, etc.; $Y_2O_3$ singly or the compound composed of $Y_{2\ O3}$ added with Gd or Eu; the compound composed of $Y_2O_2S$ added with Gd; and the compounds composed of various fluorescent substances using Cd, Ti, or Ce as an activator for the matrices. Particularly preferred compounds are M'-phase $YTaO_4$ singly or the compound composed of $YTaO_4$ added with Gd or Sr, the compound composed of LaOBr added with Gd, Tm, or Gd and Tm; and the oxide of HfZr or the compound composed of the oxide added with Ge, Ti, an alkali metal, etc.

The particle size of the fluorescent substance may be from 1 μm to 20 μm but can be changed according to the required sensitivity and the problem for the production thereof.

The coating amount of the fluorescent substance is preferably from 400 g/mm$^2$ to 2,000 g/mm$^2$ but the amount may be property changed according to the sensitivity and the image quality required. Also, by one intensifying screen, the particle size distribution of the fluorescent substance may be formed from the vicinity of the support towards the surface thereof. In this case, it is known that particle sizes of the fluorescent substance at the surface of the intensifying screen is generally large. The space filling factor of the fluorescent substance is at least 40%, and preferably at least 60%.

When the photographic light-sensitive material is photographed by disposing the fluorescent substance layer on both surfaces of the light-sensitive material, the coated amount of the fluorescent substance can be changed between the X-ray incident side and the opposite side to the incident side. It is known that since the X-ray incident side is also shielded by the intensifying screen, when a particularly high-sensitive system is required, the coating amount of the intensifying screen in the X-ray incident side is reduced.

As the support being used for the intensifying screen for use in this invention, papers, metal plates, polymer films, etc., are known but in general, a flexible sheet of polyethylene phthalate, etc., is used. If necessary, a reflecting agent or a light absorbent may be added to the support or may be formed as a different layer containing it on the surface of the support.

Also, if necessary, a fine unevenness can be formed on the surface of the support for the intensifying screen or for increasing the adhesive force between the support and a fluorescent substance layer, a pressure-sensitive adhesive layer or an electrically conductive layer may be formed on the surface of the support as an undercoat layer.

As the reflecting agent, there are zinc oxide, titanium oxide, barium sulfate, etc., but since the wavelength of the emitted light of a fluorescent substance is short, titanium oxide or barium sulfate is preferred. The reflecting agent may exist not only in the support or between the support and the fluorescent substance layer but also in the fluorescent substance layer. When the fluorescent substance exists in the fluorescent substance layer, it is preferred that the reflecting agent is omnipresent near the support.

As a binder being used for the intensifying screen for use in the present invention, there are proteins such as gelatin, etc.; natural high-molecular materials such as polysaccharides (e.g., dextran and corn starch), gum arabic, etc.; synthetic high-molecular materials such as polyvinyl butyral, polyvinyl acetate, polyurethane, polyalkyl acrylates, vinylidene chloride, nitrocellulose, fluorine-containing polymers, polyesters, etc.; and the mixtures and copolymers of them.

The fundamental performance of the preferred binder is the high transmittance to the emitted light from the fluorescent substance used. In this point, gelatin, corn starch, an acrylic polymer, a fluorine-containing olefin polymer a polymer containing a fluorine-containing olefin as a copolymer component, a styrene/acrylonitrile copolymer, etc., are preferably used. These binders may have a functional group which is crosslinked with a crosslinking agent.

Also, according to the image quality performance required, an absorbent for the emitted light from a fluorescent substance may be added to the binder or a binder having a low transmittance to the emitted light may be used. As the absorbent, there are pigments, dyes, and ultraviolet absorbing compounds.

The ratio of the fluorescent substance to the binder is generally from 1: 5 to 50: 1, and preferably from 1: 1 to 15: 1 by volume ratio. The ratio of the fluorescent substance to the binder may be uniform in the intensifying screen or nonuniform in the thickness direction.

The fluorescent substance layer is usually formed by forming a coating liquid by dispersing a fluorescent substance in a binder solution and coating the coating liquid. As the solvent for the coating liquid, there are water, organic solvents such as alcohols, chlorine-containing hydrocarbons, ketones, esters, ethers, aromatic compounds, etc, and a mixture of them.

The coating liquid may contain a dispersion stabilizer of the fluorescent substance particles, such as phthalic acid, stearic acid, caproic acid, a surface active agent, etc., and a plasticizer such as a phosphoric acid ester, a phthalic acid ester, a glycolic acid ester, polyester, polyethylene glycol, etc.

On the fluorescent substance layer of the intensifying screen being used in the present invention can be formed a protective layer. For forming the protective layer, a method of coating the layer on the fluorescent substance layer or a method of separately preparing a protective layer and laminating layer on the fluorescent substance layer is generally used.

In the case of using the coating method, the protective layer may be coated simultaneously with the fluorescent substance layer or after coating the fluorescent substance layer and drying, the protective layer may be coated thereon. The material for the protective layer may be the same material as the binder for the fluorescent substance layer or may be a different material from the binder.

As the material being used for the protective layer, there are, in addition of the materials described above as the binder for the fluorescent substance layer, cellulose derivatives, polyvinyl chloride, phenol resins, epoxy resins, etc. As the preferred materials, there are gelatin, corn starch, an acrylic copolymer, a fluorine-containing olefin polymer, a polymer containing a fluorine-containing olefin as a copolymer component, a styrene/acrylonitrile copolymer, etc.

The thickness of the protective layer is generally from 1 μm to 20 μm, preferably from 2 μm to 10 μm, and more preferably from 2 μm to 6 μm.

It is preferred to apply an emboss work onto the surface of the protective layer in this invention. Also, a matting agent may exist in the protective layer or a material having a light-scattering property to the emitted light according to images required, such as titanium oxide, etc., may exist therein.

To the protective layer of the intensifying screen being used in this invention may be imparted a surface lubricating property. As a preferred lubricant, there are a polysiloxane skeleton-containing oligomer and a perfluoroalkyl group-containing oligomer.

To the protective layer in this invention may be imparted an electric conductivity. As the conductivity-imparting agent, there are white or transparent inorganic electrically conductive materials and organic antistatic agents. As the preferred inorganic electrically conductive material, there are a ZnO powder, a whisker, $SnO_2$, ITO, etc.

Now, there are no particular restrictions about various kinds of additives which are used for the photographic material of the present invention and, for example, the materials and methods described in the following portions of JP-A-2-68539 can be used.

| Item | Described Portions of JP-A-2-68539 |
|---|---|
| 1. AgX Emulsion and Production Method | Page 8, right lower column, line 6 from the bottom to page 20, right upper column, line 12. |
| 2. Chemical Sensitization Method | Page 20, right upper column, line 13 to left column, 12 line. |
| 3. Antifoggant and Stabilizer | Page 10, left lower column, line 17 to page 11, left upper column and page 3, left lower column, line 2 to page 4, left lower column. |
| 4. Spectral Sensitizing Dye | Page 4, right lower column, line 4 to page 8, right lower column. |
| 5. Surface Active Agent and Antistatic Agent | Page 11, left upper column, line 14 to page 12, left upper column, line 9. |
| 6. Matting Agent, Lubricant, Plasticizers | Page 12, left upper column, line 10 to right upper column, line 10, and page 14, left lower column, line 10 to lower column, line 1. |
| 7. Hydrophilic Colloid | Page 12, right upper column, line 11 to left lower column, line 16. |
| 8. Hardening Agent | Page 12, left lower column, line 17 to page 13, right upper column, line 6. |
| 9. Support | Page 13, right upper column, line 7 to line 20. |
| 10. Dyes and Mordant | Page 13, left lower column, line 1 to page 14, left lower column, line 9. |

Then, the following examples are intended to illustrate the present invention in more practically but not to limit the invention in any way.

EXAMPLE 1

Preparation of Emulsion A of the Invention:

In a reaction vessel were placed 1582 ml of an aqueous gelatin solution [containing 19.5 g of gelatin-1 (deionized alkali-treated bone gelatin having a methionine content of about 40 μmol/g) and 7.8 ml of an aqueous solution of 1N $HNO_3$, pH 4.3)]and 13 ml of an NaCl-1 liquid (containing 10 g of NaCl in 100 ml of the liquid) and while keeping the temperature of the mixture at 40° C., 15.6 ml of an Ag-1 liquid (containing 20 g of $AgNO_3$ in 100 ml of the liquid) and 15.6 ml of an X-1 liquid (containing 17.05 g of NaCl in 100 ml of the liquid) were simultaneously added to the mixture at a rate of 62.4 ml/minute each followed by mixing. After stirring the mixture for 3 minutes, 28.2 ml of an X-2 liquid (containing 1.1 g of KBr in 100 ml of the liquid) was added thereto at a rate of 80.6 ml/minute each. Then, after stirring the resultant mixture for 3 minutes, 46.8 ml of the Ag-1 liquid and 46.8 ml of the X-1 liquid were simultaneously added to the mixture at a rate of 62.4 ml/minute each. After stirring the mixture for 2 minutes, 203 ml of an aqueous gelatin solution (containing 13 g of gelatin-1, 1.3 g of NaCl and an aqueous 1N NaOH solution for adjusting the pH to 6.5) was added to the solution, after adjusting the pCl thereof to 1.75, the temperature thereof was raised to 65° C., and the pCl of the mixture was adjusted to 1.95 followed by ripening for 3 minutes. Thereafter, an Ag-2 liquid (containing 50 g of $AgNO_3$ in 100 ml of the liquid) and an X-3 liquid (containing 16.9 g of NaCl and 1.4 g of KBr in 100 ml of the liquid) were added by a controlled double jet (C.D.J.) method for 20 minutes at a definite flow rate each until the addition amount of the Ag-3 liquid became 182 ml. Then, a precipitant was added to the reaction mixture and after lowering the temperature to 35° C., AgX grains formed were precipitated and washed with water. Then, an aqueous gelatin solution was added to the AgX grains and the pH thereof was adjusted to 6.0 at 60° C.

Then, the TEM images of the replica of the AgX grains formed were observed. The AgX grains of the AgX emulsion obtained were silver chlorobromide {100} tabular grains containing 3.95 mol % AgBr with silver as a standard. The shape characteristic values of the tabular grains were as follows;

(The total projected area of the {100} tabular grains having an aspect ratio of from 2 to 25/ the sum of the projected areas of the total AgX grains)×100=$a_1$=91

(The average aspect ratio (the average of aspect ratios) of the {100} tabular grains having an aspect ratio of from 2 to 25)=$a_2$=12.1

(The average diameter of the {100} tabular grains having an aspect ratio of from 2 to 25)=$a_3$=1.45 μm (The average of the major face edge length ratios of the {100} grains having an aspect ratio of from 2 to 25)=$a_4$=1.21

(The average thickness of the {100} grains having an aspect ratio of from 2 to 25)=$a_5$=0.12 μm (The variation coefficient (standard deviation of thickness/average thickness) of the thickness distribution of the {100} tabular grains having an aspect ratio of from 2 to 25)=$a_6$=0.13

(The total projected area of the grains which are the {100} tabular grains having an aspect ratio of from 2 to 25 and in which two dislocation lines are observed in the intermediate grains which have grown until the projected area became 75% of the finished tabular grains/ the projected area of the total AgX grains)×100=$a_7$=85

(The average angle of the angles each made by the two dislocation lines) =$a_8$=57°.

Also, when the tabular AgX grains obtained were observed by the direct TEM images, in the AgX emulsion even after coating, the dislocation lines of this invention could be observed in the tabular grains of 75% in the projected area.

Preparation of Emulsion B of the Invention:

In the procedure of producing the emulsion A of the present invention, the pCl after raising the temperature to 70° C. was adjusted to 1.75, thereafter while keeping the pCl at constant, and in place of adding the Ag-2 liquid and the X-3 liquid, an AgBrCl fine grain emulsion (E-1) (average grain diameter 0.1 μm, Br content 4 mol %) was added for 20 minutes at an addition rate of AgCl of $2.68\times10^{\times2}$ mol/minute.

The TEM images of the AgX grains of the emulsion thus obtained were observed. The AgX grains of the emulsion obtained were silver chlorobromide {100} tabular grains grown containing 3.94 mol % AgBr with silver as the standard.

The shape characteristics values of the tabular grains were $a_1$=91, $a_2$=12.7, $a_3$=1.51 μm, $a_4$=1.22, $a_5$=0.11 μm, $a_{6=0.13}$, $a_7$=90, and $a_8$=59°.

Also, in the tabular AgX grains of the emulsion even after coating, the dislocation lines of this invention could be observed in the tabular AgX grains of 79% in the projected area.

Preparation of Emulsion C of the Invention:

In the procedure of producing the emulsion A of the present invention, AgX gains were prepared by adding an X-4 liquid (containing 17.4 g of NaCl and 0.4 g of KBr in place of adding the X-3 liquid. The TEM images of the replica of the AgX grains of the emulsion obtained were observed.

The AgX grains of the emulsion obtained were silver chlorobromide {100} tabular grains containing 1.32 mol % AgBr with silver as the standard.

The shape characteristics values of the tabular grains were $a_1$=91, $a_2$=9.6, $a_3$=1.34 μm, $a_4$=1.35, $a_5$=0.14 μm, $a_6$=0.16, $a_7$=78, and $a_8$=56°.

Also, in the tabular AgX grains of the emulsion even after coating, the dislocation lines of this invention could be observed in the tabular AgX grains of 64% in the projected area.

Preparation or Emulsion D of the Invention:

In the procedure of producing the emulsion B of the present invention, AgX grains were prepared by adding an AgBrCl fine grain emulsion (E-2) (average grain diameter 0.1 μm, Br content 1 mol %) in place of adding the AgBrCl fine grain emulsion (E-1). The TEM images of the replica of the AgX grains of the emulsion obtained were observed.

The AgX grains of the emulsion obtained were silver chlorobromide {100} tabular grains containing 1.32 mol % AgBr with silver as the standard.

The shape characteristics values of the tabular grains were $a_1$=91, $a_2$=10.7l , $a_{3b=1.39}$ 82 m, $a_4$=1.30, $a_5$=0.13 μm, $a_6$=0.13, $a_7$=83, and $a_8$=57°.

Also, in the tabular AgX grains of the emulsion even after coating, the dislocation lines of this invention could be observed in the tabular AgX grains of 71% in the projected area.

Preparation of Emulsion E of the Invention:

In the procedure of producing the emulsion A of the present invention, AgX grains were prepared by adding an X-5 liquid (containing 17.6 g of NaCl mol % a ferrocyanide) in place of adding the X-3 liquid. The TEM images of the replica of the AgX grains of the emulsion obtained were observed.

The AgX grains of the emulsion obtained were silver chlorobromide {100} tabular grains containing 0.44 mol % AgBr with silver as the standard.

The shape characteristics values of the tabular grains were $a^1$=91, $a_2$=9.8, $a_3$=1.33 μm, $a_4$=1.41, $a_5$=0.14 μm, $a_6$=0.15, $a_7$=77, and $a_8$=57°.

Also, in the tabular AgX grains of the emulsion even after coating, the dislocation lines of this invention could be observed in the tabular AgX grains of 66% in the projected area.

Preparation of Emulsion F of the Invention:

In the procedure of procedure the emulsion Ba of the present invention, AgX grains were prepared by adding an AgCl fine grain emulsion (E-3) (average grain diameter 0.1 μm, containing 1 mol % a ferrocyanide) in place of adding the AgBrCl fine grain emulsion. The TEM images of the replica of the AgX grains of the emulsion obtained were observed.

The AgX grains of the emulsion obtained were silver chlorobromide {100} tabular grains containing 1.32 mol % AgBr with silver as the standard.

The shape characteristics values of the tabular grains were $a_1$=91, $a_2$=11.1, $a_3$=1.41 μm, $a_4$=1.30, $a_5$=0.32 μm, $a_6$=0.12, $a_7$=80, and $a_8$=59°.

Also, in the tabular AgX grains of the emulsion even after coating, the dislocation lines of this invention could be observed in the tabular AgX grains of 71% in the projected area.

Preparation of Comparative Emulsion G:

In the procedure of producing emulsion A of the present invention, tabular AgX grains were prepared by adding an X-6 liquid (containing 17.6 g of NaCl in 100 ml of the liquid) in place of adding the X-3 liquid. The TEM images of the replica of the AgX grains of the emulsion obtained were observed.

The AgX grains of the emulsion obtained were silver chlorobromide {100} tabular grains containing 0.44 mol % AgBr with silver as the standard.

The shape characteristics values of the tabular grains were $a_1$=82, $a_2$=6.7, $a_3$=1.20 μm, $a_4$=1.65, $a_5$=0.18 μm, $a_6$=0.17, $a_7$=7, and $a_8$=57°.

Preparation of Comparative Emulsion H:

In the procedure of producing the emulsion B of the present invention, tabular AgX grains were prepared by adding an AgCl fine grain emulsion (E-4) (average grain diameter 0.1 μm) in place of adding the AgBrCl fine grain emulsion (E-1). The TEM images of the replica of the AgX grains of the emulsion obtained were observed.

The AgX grains of the emulsion obtained were silver chlorobromide {100} tabular grains containing 0.44 mol % AgBr with silver as the standard.

The shape characteristics values of the grains were $a_1$=91, $a_2$=7.2, $a_3$=1.23 μm, $a_4$=1.57, $a_5$=0.17 μm, $a_6$=0.14, $a_7$=8, and $a_8$=57°.

Chemical Sensitization:

Each of the AgX emulsion produced as described above was subjected to a chemical sensitization with stirring at 60° C.

First, thiosulfonic compound-I shown below was added to the emulsion in an amount of $10^{-4}$ mol per mol of the silver halide. Then $1\times10^{-6}$ mol/mol-Ag of thiourea dioxide was added thereto, and while keeping the emulsion as it was for 22 minutes, a reduction sensitization was applied. Then, $3\times10^{-4}$ mol/mol-Ag of 4-hydroxy-6-methyl-1,3,3a,7-tetraazaindene was added thereto together with sensitizing dye -1 and sensitizing dye -2 shown below. Furthermore, calcium chloride was also added to the mixture. Thereafter, $6\times10^{-6}$ mol/mol-Ag of sodium thiosulfate and $4\times10^{-6}$ mol/mol-Ag of Selenium compound-I were added thereto. Furthermore, $1\times10^{-5}$ mol/mol-Ag of chloroauric acid and $10^{-3}$ mol/mol-Ag of potassium thiocyanic acid were added to the emulsion and after 40 minutes since then, the emulsion was cooled to 35° C.

Thus, the adjustment (chemical ripening) of each AgX emulsion was finished.

Thiosulfonic acid compound - I:

$C_2H_5SO_2SNa$

-continued

Sensitizing Dye - 1

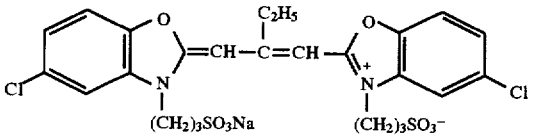

$1 \times 10^{-3}$ mol/mol-Ag

Sensitizing Dye - 2

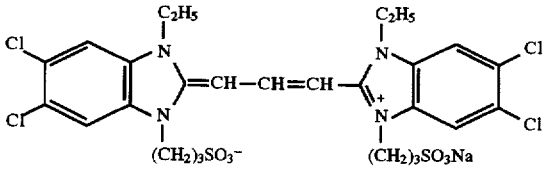

$1 \times 10^{-5}$ mol/mol-Ag (Preparation of Emulsion Coated Layer)

An emulsion coating liquid was prepared by adding the following chemicals per mole of the silver halide to each emulsion thus subjected to the chemical sensitization.

| | |
|---|---|
| Gelatin (including gelatin in the emulsion) | 111 g |
| Dextran (average molecular weight 39,000) | 21.5 g |
| Sodium Polyacrylate (average molecular weight 400,000) | 5.1 g |
| Hardening Agent: 1, 2-bis (vinylsulfnylacetamido)ethane The addition amount was adjusted such that the swelling ratio became 230%. | |
| Compound - I | 42.1 g |
| Compound - II | 10.3 g |
| Compound - III | 0.11 g |
| Compound - IV | 8.5 mg |
| Compound - V | 0.43 g |
| Compound - VI | 0.004 g |
| Compound - VII | 0.1 g |
| Compound - VIII | 0.1 g |
| pH adjusted to 6.1 with NaOH. | |

Compound - I

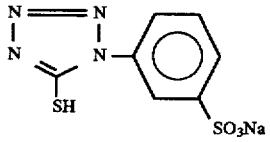

Compound - II

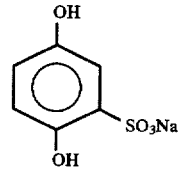

Compound - III

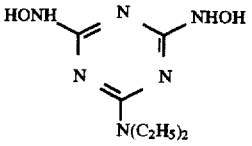

Compound - IV

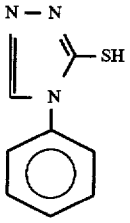

Compound - V

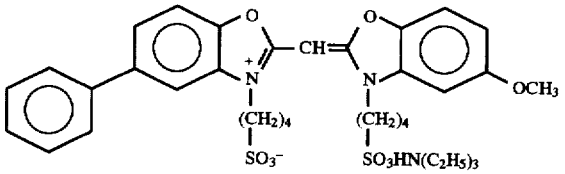

Compound - VI

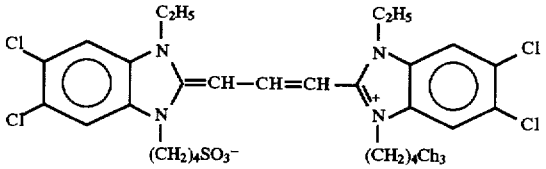

Compound - VII

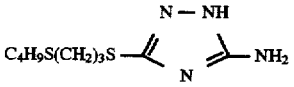

Compound - VIII

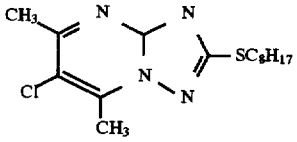

To each of the coating liquids described above was added Dye Emulsion A prepared as shown below so that the coated amount of Dye-I shown below became 10 mg/m$^2$ per one surface of the support.

Dye-I

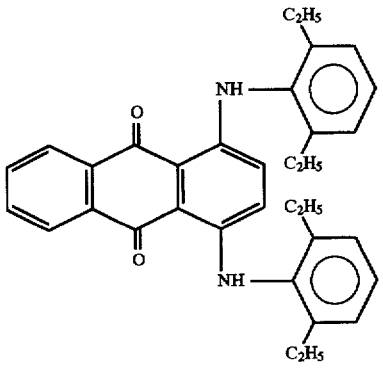

(Preparation of Dye Emulsion A)

In a mixed solvent of 62.8 g of High-Boiling Organic Solvent-I, 62.8 g of High-Boiling Organic Solvent-II shown below, and 333 g of ethyl acetate was dissolved 60 g of the Dye-I described above at 60° C. Then, 65 ml of an aqueous solution of 5% sodium dodecylsulfonate, 94 g of gelatin, and 58 ml of water were added and the resultant mixing was dispersed by emulsification by a dissolver for 30 minutes at 60° C. Then, after adding 2 g of Compound-IX described below and 6 liters of water thereto, the temperature of the mixture was lowered to 40° C. Then, the mixture was concentrated using Ultrafiltration Labomojule ACP 1050 (manufactured by Asahi Chemical Industry Co., Ltd. ) until the total amount thereof became 2 kg and 1 g of Compound-IX described below was added thereto to provide Dye Emulsion A.

High-Boiling Organic Solvent - I

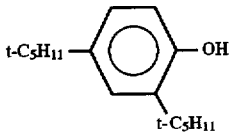

High-Boiling Organic Solvent - II

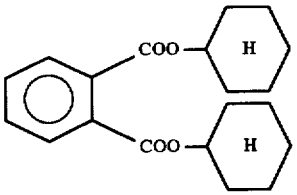

Compound - IX

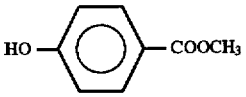

(Preparation of Surface Protective Layer Coating Liquid )

A surface protective layer coating liquid was prepared by mixing the following components at the coating amounts shown below.

| | |
|---|---|
| Gelatin | 0.780 g/m$^2$ |
| Sodium Polyacrylate (average molecular amount 400,000) | 0.035 g/m$^2$ |
| Sodium Polystyrenesulfonate (average molecular amount 600,000) | 0.0012 g/m$^2$ |
| Polymethyl Methacrylate (average particle diameter 3.7 μm) | 0.072 g/m$^2$ |
| Coating Aid - I | 0.020 g/m$^2$ |
| Coating Aid - II | 0.037 g/m$^2$ |
| Coating Aid - III | 0.0080 g/m$^2$ |
| Coating Aid - IV | 0.0032 g/m$^2$ |
| Coating Aid - V | 0.0025 g/m$^2$ |
| Compound - X | 0.0022 g/m$^2$ |
| Proxel (pH adjusted to 6.8 with NaOH) | 0.0010 g/m$^2$ |

Coating Aid - I

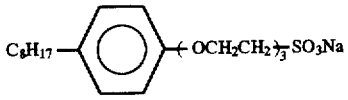

Coating Aid - II

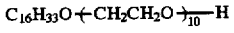

Coating Aid - III

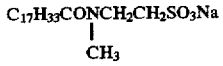

Coating Aid - IV

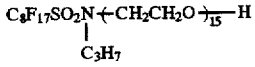

Coating Aid - V

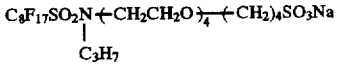

Compound - X

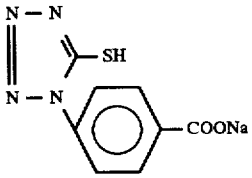

(Preparation of Support)

(1) Preparation of Dye Dispersion B for Undercoat Layer

Following Dye-II was treated in a ball mill by the method described in JP-A-63-197943.

Dye-II

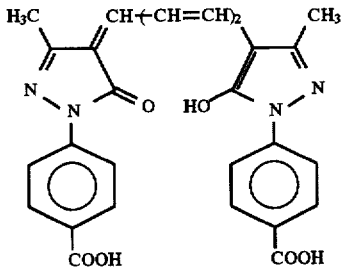

In a 2 liter ball mill were placed 434 ml of water and 791 ml of an aqueous solution of 6.7% a surface active agent, Triton X200 (registered trade name) or (TX-200, registered trade name). Then, 20 g of the dye described above was added to the solution in the ball mill. After adding thereto 400 ml of the beads (diameter 2 mm) of zirconium oxide ($ZrO_2$), the content was ground for 4 days. Thereafter, 160 g of 12.5% gelatin was added to the ground mixture. After defoaming, the ZrO2 beads were removed by flirtation.

When the dye dispersion obtained was Observed, the particle sizes of the ground dye had a wide range of from 0.05 μm to 1.15 μm and the average particle size thereof was 0.37 μm. Furthermore, the large dye particles of 0.9 μm or larger were removed by applying a centrifugal separation.

Thus, Dye Dispersion B was obtained.

(2) Preparation of Support Corona discharging was applied onto a biaxially stretched polyethylene terephthalate film of 175 μm in thickness, a 1st undercoat liquid having the composition described below was coated on the film by a wire bar coater at a coated amount of 4.9 ml/m$^2$ and dried for one minute at 185° C.

Then, the 1st undercoat liquid was coated on the opposite surface of the film by the same manner as above. In this case, the polyethylene terephthalate film used contained 0.04% by weight Dye-I described above.

| Composition of 1st Undercoat Liquid | |
|---|---|
| Solution of Butadiene-Styrene Copolymer Latex (solid content 40% butadiene/styrene = 31/69 by weight ratio | 158 ml |
| 4% Solution of 2,4-Dichloro-6-hydroxy-s-triazine Sodium Salt | 41 ml |
| Distilled Water | 80 ml |

The latex solution described above contained the following compound as an emulsification-dispersing agent in an amount of 0.4% by weight to the latex solid components.

Emulsification-Dispersing Agent

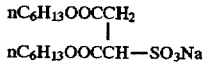

(3 ) Preparation of Undercoat Layer

A 2nd undercoat liquid having the following composition was coated on the 1st undercoat layer on both surfaces of the support film by a wire bar coater system at the coating amounts (for each component) shown below per one side and dried at 155° C.

| | |
|---|---|
| Gelatin | 80 mg/m$^2$ |
| Dye Dispersion B (as dye solid component) | 8 mg/m$^2$ |
| Coating Aid VI | 1.8 mg/m$^2$ |
| Compound - XI | 0.27 mg/m$^2$ |
| Matting Agent: Polymethyl Methacrylate having average particle size of 2.5 μm | 2.5 mg/m$^2$ |

Coating Aid - VI $C_{12}H_{25}O(CH_2CH_2O)_{10}H$

Compound - XI

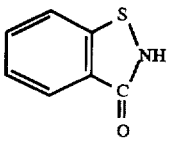

(Preparation of Photographic Material)

On both surfaces of the support described above were formed each of the emulsion layer and the surface protective layer described above by a simultaneous extrusion method. In this case, the coated amount of silver was 1.75 g/m$^2$ per one surface.

(Evaluation of Photographic Performance)

Ultravision Fast Detail (trade name, made by E.I. Du Pont de Nemours and Company) was stuck to both the surface of each photographic light-sensitive material prepared as described above and both the surfaces were exposed to X rays for 0.05 second to perform an X-ray sensitometry. The exposure amount was controlled by changing the distance between an X-ray tube and the cassette. After exposure, the sensitivity was evaluated using the automatic processor and processing liquids described below. The sensitivity was expressed by the logarithm of the reciprocal of the exposure amount required for giving a fog+0.1 and shown by a relative value with the sensitivity of the emulsion A being defined as 100.

(Processing)

Automatic Processor: CEPROS 30 (trade name, manufactured by Fuji Photo Film Co., Ltd., and dry to dry was 30 seconds.

Preparation of Concentrated Liquids:

| [Developer] | |
|---|---|
| Part Agent A: | |
| Potassium Hydroxide | 330 g |
| Potassium Sulfite | 630 g |
| Sodium Sulfite | 255 g |
| Potassium Carbonate | 90 g |
| Boric Acid | 45 g |
| Diethylene Glycol | 180 g |
| Diethylenetriaminepentaacetic Acid | 30 g |
| 1-(N,N-Diethylamine)ethyl-5-mercaptotetrazole | 0.75 g |
| Hydroquinone | 450 g |
| 4-Hydroxymethyl-4-methyl-1-phenyl-3-pyrazolidone | 60 g |
| Water added to make | 4125 ml |
| Part Agent B: | |
| Diethylene Glycol | 525 g |
| 3,3'-Dithobishydrocinnamic Acid | 3 g |
| Glacial Acetic Acid | 102.6 g |
| 2-Nitroindazole | 3.75 g |
| 1-phenyl-3-pyrazolidone | 34.5 g |
| Water to make | 750 ml |
| Part Agent C: | |
| Glutaraldehyde (50 wt./vol. %) | 150 g |
| Potassium Bromide | 15 g |
| Potassium Metabisulfite | 105 g |
| Water to make | 750 ml |
| [Fix Liquid] | |
| Ammonium Thiosulfate (70 wt./vol. %) | 3000 ml |
| Ethylenediaminetetraacetic Acid-Disodium-Dihydrate | 0.45 g |
| Sodium Sulfite | 225 g |
| Boric Acid | 60 g |
| 1-(N,N-Diethylamine)-ethyl-5-mercaptotetrazole | 15 g |
| Tartaric Acid | 48 g |
| Glacial Acetic Acid | 675 g |
| Sodium Hydroxide | 225 g |
| Sulfuric Acid (36N) | 58.5 g |
| Aluminum Sulfate | 150 g |
| Water to make | 6000 ml |
| pH | 4.68 |

(Preparation of Processing Liquids)

The developer concentrates described above were filled in the following container per each part agent. These container was constituted by connecting each part container for each of the part agents A, B, and C in one body.

Also, the fix liquid concentrate was filled in a same kind of a vessel.

First, 300 ml of an aqueous solution containing 54 g of acetic acid and 55.5 g of potassium bromide was added into the development bath.

Each container containing each processing liquid was inverted and mounted on each stock tank for processing liquid equipped to the side of an automatic processor in such a manner that each perforating edge of the stock tank was inserted into the cap of each container and broke the sealing membrane of the cap, whereby each processing liquid in each container was filled in the stock tank.

In this case, each processing liquid was filled at the following ratios in the development bath and the fix bath of the automatic processor by operating the pumps equipped to the automatic processor.

Also, after processing 8 sheets of the photographic light-sensitive materials each having an area of 10 inch×12 inch, each processing liquid concentrate was mixed with water at the ratio and filled in each processing bath of the automatic processor.

| | |
|---|---|
| **Developer** | |
| Part Liquid A | 5 ml |
| Part Liquid B | 10 ml |
| Part Liquid C | 10 ml |
| Water | 125 ml |
| pH | 10.50 |
| **Fix Liquid** | |
| Fix Liquid Concentrate | 80 ml |
| Water | 120 ml |
| pH | 4.61 |

Also, city water was filled in a wash bath.

Furthermore, as a fur inhibitor, 3 polyethylene bottles (the opening portion of each bottle was covered by a nylon cloth of 300 mesh and water and bacteria can pass through the cloth) each having filled therein 0.4 g of pearlite having a mean particle size of 100 μm and a mean pore diameter of 3 μm carrying thereon Actinomyces were prepared, in these bottles, 2 bottles were placed on the bottom of the wash bath and one bottle was placed on the bottom of the stock tank (liquid amount 0.2 liter) for wash water.

Processing Speed and Processing Temperature:

| | | |
|---|---|---|
| Development | 35° C. | 8.8 seconds |
| Fix | 32° C. | 7.7 seconds |
| Wash | 17° C. | 3.8 seconds |
| Squeegee | | 4.4 seconds |
| Drying | 58° C. | 5.3 seconds |
| Total | | 30 seconds |

Replenishing Amount:

| | |
|---|---|
| Developer | 25 ml/10 inch × 12 inch |
| Fix Liquid | 25 ml/10 inch × 12 inch |

When an image formation was carried out at X-ray exposure using each of the photographic light-sensitive materials of this invention and the fluorescent intensifying screen having the peak intensity in the range of from 320 to 380 nm described in JP-A-6-11804, it was confirmed that good X-ray images were formed.

When the shape characteristic value of the tabular grains of the AgX emulsions A to F of the present invention was compared with those of the AgX grains of the comparative AgX emulsions G and H, it can be astonishingly seen that the tabular AgX grains of the emulsions A to F of the present invention have a high aspect ratio as compared with those of the comparative emulsions G and H. This means that the anisotropic growing property of the tabular grains of the emulsions of the present invention is very excellent as compared with that of the grains of the comparative emulsions G and H.

Also, when the tabular grains of the emulsions A to F of the present invention are compared with the grains of the comparative examples G and H, it can be seen that the variation coefficient of the thickness distribution of the tabular grains of the emulsions A to F of the present invention is very small as compared with that of the grains of the comparative emulsions G and H. They correspond to the result that when the direct TEM images of the tabular grains are observed, in the AgX emulsions A to F of the present invention, there are many tabular grains having confirmed the dislocation lines of this invention, while in the comparative emulsions G and H, the presence of the dislocation lines is astonishingly scarcely confirmed.

The results of measuring the sensitivities of the photographic light-sensitive materials each using each of the emulsions A to F of the present invention and each of the comparative emulsions G and H are shown in Table 1 below. (In the results, the sensitivity of the comparative emulsion H is defined as 100. )

TABLE 1

| Coated Emulsion | Sensitivity | Fog |
|---|---|---|
| A | 196 | 0.06 |
| B | 204 | 0.05 |
| C | 155 | 0.05 |
| D | 168 | 0.04 |
| E | 127 | 0.04 |
| F | 132 | 0.04 |
| G | 95 | 0.12 |
| H | 100 | 0.08 |

As is clear from the results shown in Table 1, it can be seen that the photographic light-sensitive materials of the present invention show a high sensitivity and low fog in quick processing.

EXAMPLE 2

In the case of preparing the emulsions A to H, the chemical sensitization was carried out using Tellurium Compound-I in place of Selenium Compound-I and other procedures were followed by the same procedures as in Example 1.

The results showed that in the case of using the tellurium compound, the emulsions A to G of the present invention showed a high sensitivity and low fog as in the case of using the selenium compound.

As described above, the AgX emulsions of the present invention are excellent in the high aspect ratio, the high sensitivity, and low fog.

While the invention has been described in detail and with reference to specific embodiments thereof, it will be apparent to one skilled in the art that various changes and modifications can be made therein without departing from the spirit and scope thereof.

What is claimed is:

1. A silver halide emulsion comprising at least a dispersing medium and silver halide grains, wherein the silver halide grains have an AgCl content of from 30 mol % to 100 mol %; and at least 30% of the sum of the projected area of the silver halide grains are tabular grains which satisfy the following conditions (i) to (v):

(i) the tabular grains have {100} faces as major faces;

(ii) the tabular grains have an aspect ratio (circle-equivalent diameter/thickness of from 2.0 to 25;

(iii) the tabular grains have an average thickness of from 0.02 μm to 0.3 μm;

(iv) the tabular grains have an average major face edge length ratio of from 1 to 5; and (v) the tabular grains have been grown from intermediate grains which have two dislocation lines extending from about the nucleus until the intermediate grains have a projected area of about 75% or more of the projected area of the finished tabular grains, wherein the angle made by the two dislocation lines is from 5° to 85° when viewed in a direction perpendicular to the major face of the tabular grain.

2. The silver halide emulsion of claim 1, wherein the tabular grains have been grown from intermediate grains which have two dislocation lines extending from about the nucleus until the intermediate grains have a projected area of about 85% or more of the projected area of the finished tabular grains.

3. The silver halide emulsion of claim 2, wherein the tabular grains have been grown from intermediate grains which have two dislocation lines extending from about the nucleus until the intermediate grains have a projected area of about 99% or more of the projected area of the finished tabular grains.

4. The silver halide emulsion of claim 1, wherein the two dislocation lines exist in the tabular grains coated in a silver halide photographic material.

5. The silver halide emulsion of claim 1, wherein the angle made by the two dislocation lines is from 30° to 75°.

6. The silver halide emulsion of claim 5, wherein the angle made by the two dislocation lines is from 45° to 75°.

7. The silver halide emulsion of claim 1, wherein at least 45% of the sum of the projected area of the silver halide grains are tabular grains.

8. The silver halide emulsion of claim 7, wherein at least 60% of the sum of the projected area of the silver halide grains are tabular grains.

9. The silver halide emulsion of claim 1, wherein the silver halide grains have an AgCl content of from 50 mol % to 100 mol %.

10. The silver halide emulsion of claim 9, wherein the silver halide grains have an AgCl content of from 80 mol % to 100 mol %.

11. The silver halide emulsion of claim 1, wherein the nucleus at the nucleation exists in a regular square of from 0.001% to 10% of the projected area of each of the tabular grains, the regular square including one corner of each of the tabular grains.

12. The silver halide emulsion of claim 1, which is subjected to a gold sensitization and at least a calcogen sensitization.

13. A silver halide photographic material comprising a support and at least one silver halide emulsion is coated on at least one side of the support, wherein the silver halide emulsion comprises at least a dispersing medium and silver halide grains, wherein the silver halide grains have an AgCl content of from 30 mol % to 100 mol %; at least 30% of the sum of the projected area of the silver halide grains are tabular grains which satisfy the following conditions (i) to (v):

(i) the tabular grains have {100} faces as major faces;

(ii) the tabular grains have an aspect ratio (circle-equivalent diameter/thickness) of from 2.0 to 2.5;

(iii) the tabular grains have an average thickness of from 0.02 μm to 0.3 μm;

(iv) the tabular gains have an average major face edge length ratio of from 1 to 5; and (v) the tabular grains have been grown from intermediate grains which have two dislocation lines extending from about the nucleus until the intermediate grains have a projected area of about 75% or more of the projected area of the finished tabular grains, wherein the angle made by the two dislocation lines is from 5° to 85° when viewed in a direction perpendicular to the major face of the tabular grain.

14. The silver halide photographic material of claim 13, wherein the silver halide emulsion is located on both sides of the support.

15. The silver halide photographic material of claim 14, which is used with a fluorescent intensifying screen, wherein the fluorescent intensifying screen emits light by an X-ray exposure having a peak at a wavelength of from 200 nm to 400 nm.

16. A method for producing a silver halide emulsion comprising at least a dispersing medium and silver halide grains having an AgCl content of from 30 mol % to 100 mol %, said method comprising the step of reacting a silver compound and halide compound, wherein at least 30% of the sum of the projected area of the silver halide grains are tabular grains which satisfy the following conditions (i) to (v):

(i) the tabular grains have {100} faces as major faces;

(ii) the tabular grains have an aspect ratio (circle-equivalent diameter/thickness) of from 2.0 to 2.5;

(iii) the tabular grains have an average thickness of from 0.02 μm to 0.03 μm;

(iv) the tabular grains have an average major face edge length ratio of from 1 to 5; and (v) the tabular grains have been grown from intermediate grains which have two dislocation lines extending from about the nucleus until the intermediate grains have a projected area of about 75% or more of the projected area of the finished tabular grains, wherein the angle made by the two dislocation lines is from 5° to 85° when viewed in a direction perpendicular to the major face of the tabular grain.

17. The method of claim 16, wherein the two dislocation lines are maintained without vanishing until the intermediate grains have grown to have a projected area of about 85% or more of the projected area of the finished tabular grains.

18. The method of claim 17 wherein the two dislocation lines are maintained without vanishing until the intermediate grains have grown to have a projected area of about 99% or more of the projected area of the finished tabular grains.

19. The method of claim 16, wherein at least 45% of the sum of the projected area of the silver halide grains are tabular grains.

20. The method of claim 19, wherein at least 60% of the sum of the projected area of the silver halide grains are tabular grains.

* * * * *